US009724953B2

(12) United States Patent
Kitamura

(10) Patent No.: US 9,724,953 B2
(45) Date of Patent: Aug. 8, 2017

(54) SHEET PROCESSING APPARATUS AND IMAGE FORMING SYSTEM

(71) Applicant: KONICA MINOLTA, INC., Chiyoda-ku, Tokyo (JP)

(72) Inventor: Kei Kitamura, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/336,919

(22) Filed: Jul. 21, 2014

(65) Prior Publication Data

US 2015/0021845 A1 Jan. 22, 2015

(30) Foreign Application Priority Data

Jul. 22, 2013 (JP) ..... 2013-151734

(51) Int. Cl.

| | |
|---|---|
| ***B42B 5/00*** | (2006.01) |
| ***B42C 1/12*** | (2006.01) |
| ***B42B 4/00*** | (2006.01) |
| ***G03G 15/00*** | (2006.01) |

(52) U.S. Cl.

CPC ..... *B42C 1/12* (2013.01); *B42B 4/00* (2013.01); *G03G 15/6544* (2013.01); *B65H 2301/4215* (2013.01); *B65H 2301/436* (2013.01); *B65H 2404/232* (2013.01); *B65H 2701/1932* (2013.01); *G03G 2215/00827* (2013.01); *G03G 2215/00877* (2013.01)

(58) Field of Classification Search

CPC ..... B42B 5/00; B42B 4/00; G03G 15/6544; G03G 2215/00827; G03G 2215/00877

See application file for complete search history.

(56) References Cited

U.S. PATENT DOCUMENTS 6,929,256 B2 * 8/2005 Kawatsu et al. ..... 270/37
7,178,799 B2 * 2/2007 Wakabayashi et al. ... 270/39.06

(Continued)

FOREIGN PATENT DOCUMENTS

| | | | |
|---|---|---|---|
| JP | 2005060094 | A | 3/2005 |
| JP | 2006036402 | A | 2/2006 |
| JP | 2010241523 | A | 10/2010 |

OTHER PUBLICATIONS

JPO Machine Translation of Hattori et al., JP 2005060094 A, published Mar. 10, 2005.*

(Continued)

*Primary Examiner* — Jennifer Simmons

(74) *Attorney, Agent, or Firm* — Holtz, Holtz & Volek PC

(57) ABSTRACT

A sheet processing apparatus includes a saddle unit on which a mountain-folded sheet folded along a folding line is accumulated so as to straddle the saddle unit, a staple inserting section disposed above the saddle unit, and a staple receiving section accommodated in the saddle unit. The staple inserting section includes an inserting unit which inserts a staple into the folding lines of the sheets, and holding members disposed on both sides of the inserting unit in a direction parallel to the folding lines of the sheets. The staple receiving section includes a staple receiving unit which receives and bends the tips of the staple inserted by the inserting unit, and supporting members disposed on both sides of the staple receiving unit at positions opposite to the holding members.

7 Claims, 8 Drawing Sheets

(56) References Cited

U.S. PATENT DOCUMENTS

| | | | | |
|---|---|---|---|---|
| 8,146,906 | B2 | 4/2012 | Sugihara | |
| 2003/0161705 | A1 * | 8/2003 | Trovinger | B42B 4/00<br>412/25 |

OTHER PUBLICATIONS

Japanese Office Action (and English translation thereof) dated Jun. 30, 2015, issued in counterpart Japanese Application No. 2013-151734.

* cited by examiner

SHEET PROCESSING APPARATUS AND IMAGE FORMING SYSTEM

BACKGROUND OF THE INVENTION

1. Field of the Invention

The present invention relates to a sheet processing apparatus and an image forming system.

2. Description of Related Art

There are known some conventional sheet processing apparatuses each of which forms a booklet with a saddle stitching section including a saddle unit to sequentially accumulate sheets of paper that are mountain-folded along middle folding lines so as to straddle the saddle unit, a staple inserting unit to insert a staple from above into the folding lines of the sheets accumulated on the saddle unit and a staple receiving unit which is provided to face the staple inserting unit across the sheets and receives and bends the ends of the staples inserted by the staple inserting unit.

In a saddle stitching section described in Japanese Patent Application Laid Open Publication No. 2010-241523, for example, the staple inserting unit has a lower surface having an inverted V-shaped guide groove, the staple receiving unit is accommodated in the saddle unit, and the staple receiving unit is configured to protrude upward from the top of the saddle unit when the staple inserting unit inserts a staple into the sheets.

In the above publication, the staple inserting unit aligns the folding lines of the sheets by the guide groove thereof upon the protrusion of the staple receiving unit.

According to the configuration of the above publication, the staple inserting unit inserts a staple into sheets that are not fixed to the saddle unit, while the staple receiving unit is protruding from the top of the saddle unit. Unfortunately, the staple inserting unit cannot correct the deviation due to the significant misalignment of the ridge line of the sheets caused upon the protrusion of the staple receiving unit, resulting in misalignment of the stitch with the folding lines of the sheets.

According to the configuration in the above publication, the sheets to be stapled define the same folding angles as those when accumulated on the saddle unit, and thus a space is generated between the staple receiving unit and the sheets. Unfortunately, the staple buckles if the space is significantly large. In addition, a longer penetration length of the staple is needed to staple the sheets defining the same folding angles as those when accumulated on the saddle unit, compared to that needed in a side stitching process. This causes a disadvantage in that a smaller number of sheets can be stitched than those in the side stitching process.

SUMMARY OF THE INVENTION

The present invention has been made in consideration of the above problems in conventional techniques, and an object of the present invention is to provide a sheet processing apparatus and an image forming system that can accurately align a stitch with folding lines of accumulated sheets.

In order to achieve the above object, according to one aspect of the present invention, there is provided a sheet processing apparatus including: a saddle unit on which a mountain-folded sheet folded along a folding line at a middle portion is accumulated so as to straddle the saddle unit; a staple inserting section disposed above the saddle unit; a staple receiving section accommodated in the saddle unit; and a control section which controls the staple inserting section. The staple inserting section includes: an inserting unit which inserts a staple into the folding lines of the sheets accumulated on the saddle unit; holding members disposed on both sides of the inserting unit in a direction parallel to the folding lines of the sheets accumulated on the saddle unit; and a drive unit which drives the holding members in the vertical direction. The staple receiving section includes: a staple receiving unit which receives and bends the tips of the staple inserted by the inserting unit; and supporting members disposed on both sides of the staple receiving unit at positions opposite to the holding members, respectively. The control section controls the drive unit so that the sheets are held between the holding members and the supporting members during the driving of the staple into the folding lines of the sheets accumulated on the saddle unit with the inserting unit.

Preferably, in the sheet processing apparatus, the supporting members are prominent from an upper surface of the staple receiving unit, and the uppermost positions of the supporting members are lowered in response to the pressing force of the holding members.

Preferably, in the sheet processing apparatus, the supporting members are supported by biasing members which apply biasing force to urge the supporting members upward, and the supporting members retract downward against the biasing force of the biasing members, in response to the pressing force of the holding members.

Preferably, in the sheet processing apparatus, the holding members have lower surfaces each including a guide groove extending in the direction parallel to the folding lines of the sheets, and the supporting members each have a narrower width than the width of the guide groove in a direction orthogonal to the longitudinal direction of the guide groove.

According to another aspect of the present invention, there is provided an image forming system, including: an image forming apparatus to form images on sheets; and the sheet processing apparatus, the sheet processing apparatus being connected to the image forming apparatus to execute a saddle stitching process by driving a staple into the folding lines at the middle portion of the sheets having the images formed by the image forming apparatus.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENT

An image forming system 1 according to an embodiment of the present invention will now be described with reference to the drawings.

Figure 1:
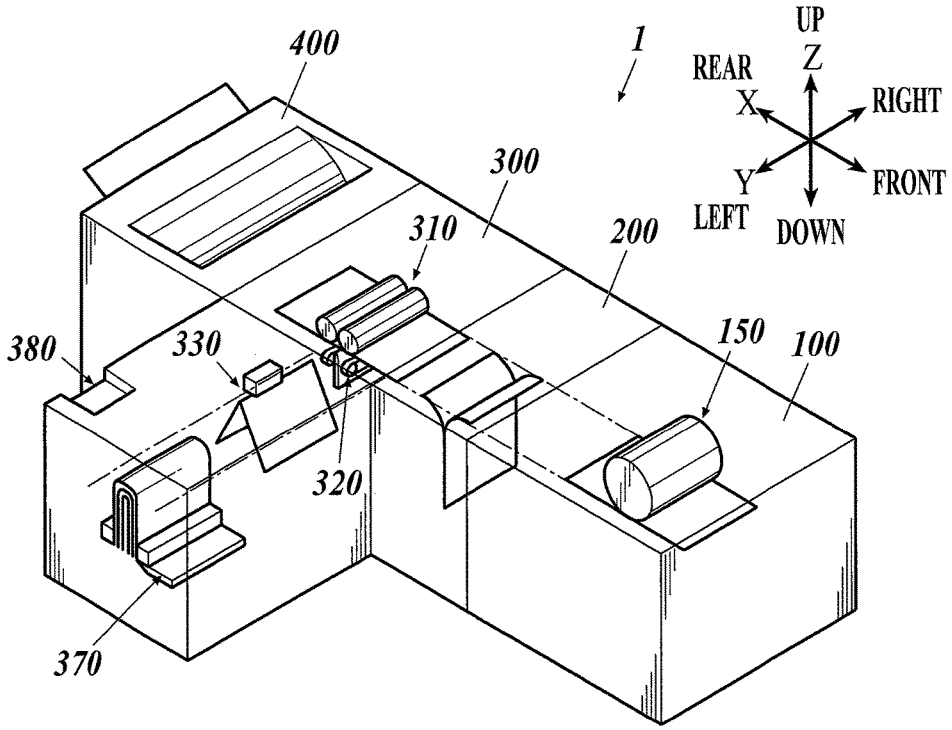
FIG. 1 is a schematic view illustrating the entire configuration of an image forming system.

FIG. 1 is a schematic view illustrating the entire configuration of the image forming system 1.

The image forming system 1 includes an image forming apparatus 100, an intermediate conveyance apparatus 200, a saddle stitching apparatus 300 and a side stitching apparatus 400.

In the following description, the vertical direction is referred to as Z direction; the direction of an array of the image forming apparatus 100, the intermediate conveyance apparatus 200, the saddle stitching apparatus 300 and the side stitching apparatus 400 in FIG. 1 is referred to as X direction; and the direction orthogonal to both the X and Z directions is referred to as Y direction.

The X direction has front and rear sides and the Y direction has right and left sides. The front side is upstream and the rear side is downstream when a sheet is conveyed in the image forming system 1. The right side is upstream and the left side is downstream when a sheet is conveyed in half folding and saddle stitching processing by the saddle stitching apparatus 300.

The image forming apparatus 100 forms an image on a sheet of paper.

In specific, the image forming apparatus 100 for forming an image on a sheet includes, for example, a conveyance section to extract and convey a sheet from the sheets stored as recording media from a sheet tray, a developing section to develop a toner image based on bitmap data onto a first transfer member such as transfer roller, a first transfer section to transfer the toner image developed on the first transfer member onto a second transfer member such as transfer drum 150, a second transfer section to transfer the toner image on the second transfer member onto the sheet conveyed by the conveyance section, a fixing section to fix the transferred toner image onto the sheet, and an ejecting section to eject the sheet after the fixation by the fixing section.

The image forming apparatus 100 passes the ejected sheet which has the image formed thereon to the intermediate conveyance apparatus 200. That is, the connection in the image forming system 1 allows the sheet ejected from the image forming apparatus 100 to be passed to the intermediate conveyance apparatus 200.

The intermediate conveyance apparatus 200 can temporarily stack a sheet and score and trim the sheet.

Specifically, the intermediate conveyance apparatus 200 includes, for example, a standby section (stacker) which conveys downward a sheet conveyed from the image forming apparatus 100 and makes the sheet stop once to standby with the sheet surface along the Z direction; an alignment section which aligns the position of the sheet during standby; a scoring section (creaser) which scores the aligned sheet; and a trimming section (slitter) which trims off margins in the sheet while the conveyance of the scored sheet.

That is, the intermediate conveyance apparatus 200 once stops the sheet passed from the image forming apparatus 100 at the standby section, aligns the sheet with the alignment section, scores the sheet with the scoring section, and thereafter trims the margins in the sheet with the trimming section while conveying the scored sheet. Then, the intermediate conveyance apparatus 200 passes the sheet with the margins trimmed off by the trimming section to the saddle stitching apparatus 300.

The intermediate conveyance apparatus 200 can also pass the sheet received from the image forming apparatus 100 to the saddle stitching apparatus 300 without performing a part or all of the various processes by the intermediate conveyance apparatus 200.

The saddle stitching apparatus 300 as a sheet processing apparatus performs half folding that is folding the sheet in half (in two), saddle stitching that is stapling a predetermined number of stacked half-folded sheets to create a saddle-stitched booklet, trimming that is trimming the end surfaces of the saddle-stitched booklet, and such like.

In specific, the saddle stitching apparatus 300 includes, for example, a half folding section 310 which folds the sheet received from the intermediate conveyance apparatus 200 in half along the Y direction, a conveyance mechanism 320 which conveys the sheet half-folded by the half folding section 310 in the direction (Y direction) along the folding line in the sheet, a saddle stitching section 330 which inserts staples into the sheet bundle to perform saddle stitching after overlying sheets conveyed from the conveyance mechanism 320, a trimming section 370 which trims the end surfaces of the saddle-stitched sheet bundle, and an ejecting section 380 which ejects the saddle-stitched booklet having the trimmed end surfaces.

The saddle stitching apparatus 300 can also pass the sheet received from the intermediate conveyance apparatus 200 to the side stitching apparatus 400 without performing a part or all of the various processes by the saddle stitching apparatus 300. The saddle stitching apparatus 300 may further include a processing section for square folding to form the spine of the saddle-stitched booklet.

Figure 2:
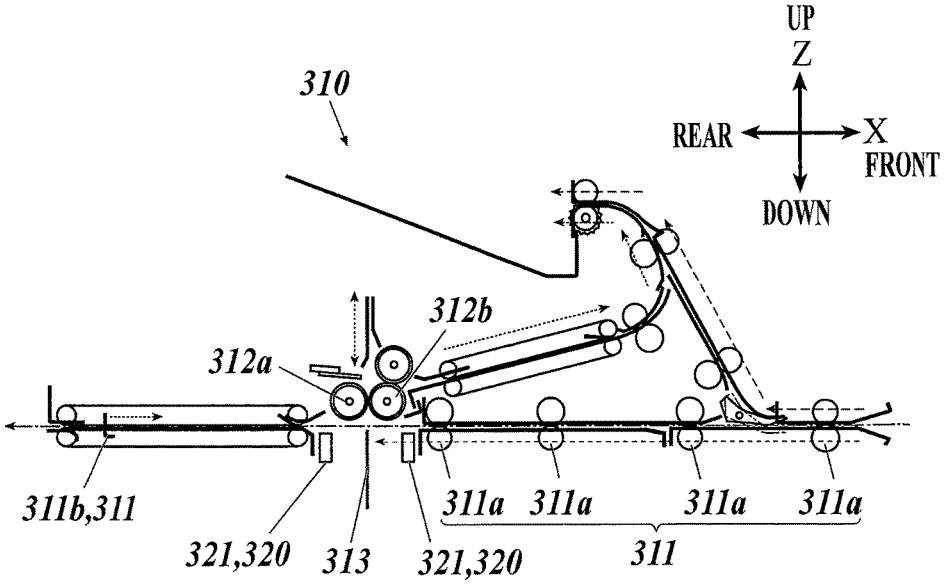
FIG. 2 is a schematic view illustrating a configuration of a half folding section in a sheet processing apparatus as an example.

FIG. 2 is a schematic view illustrating the configuration of the half folding section 310 as an example.

The half folding section 310 includes, for example, a conveyance unit 311 which conveys the sheet received from the image forming apparatus 100 to a predetermined position, a pair of half folding rollers 312*a*, 312*b* which is located above the sheet stopped at the predetermined position and a plate-like folding knife 313 which is located below the pair of half folding rollers 312*a*, 312*b* and movable so as to come between the half folding rollers 312*a*, 312*b*.

The conveyance unit 311 conveys the sheet received from the image forming apparatus 100 downstream with the sheet surface in nearly parallel to the X-Y plane by a plurality of pairs of conveyance rollers 311*a*, and locks the end at downstream side in conveyance direction of the conveyed sheet to locate and stop the sheet at a predetermined position with a stopper 311*b* provided on the conveyance path.

The predetermined position is a position where the central portion in the X direction of the conveyed sheet face the folding knife 313. In order to stop the sheet at such predetermined position, the position of the stopper 311*b* on the conveyance path is appropriately set according to the sheet size.

The half folding rollers 312*a*, 312*b* are cylindrical rollers provided to be rotatable and function as a nip unit along the Y direction by contacting each other at the outer circumferential surfaces.

The folding knife 313 is a plate like member provided along Y-Z plane. When the sheet is located between the pair of half folding rollers 312*a*, 312*b* and the folding knife 313, the folding knife 313 comes between the half folding rollers 312*a*, 312*b*, and thereby presses the sheet into the nip unit. Thus, the sheet is folded in two so as to have a folding line along the Y direction at the position contacting the folding knife 313. That is, the sheet is in what is called a mountain fold shape with the folding line up and the both ends down (mountain-shaped sheet).

In such half folding process, a sheet may be folded one by one or every plurality of sheets may be folded (for example, every three sheets).

Figure 3:
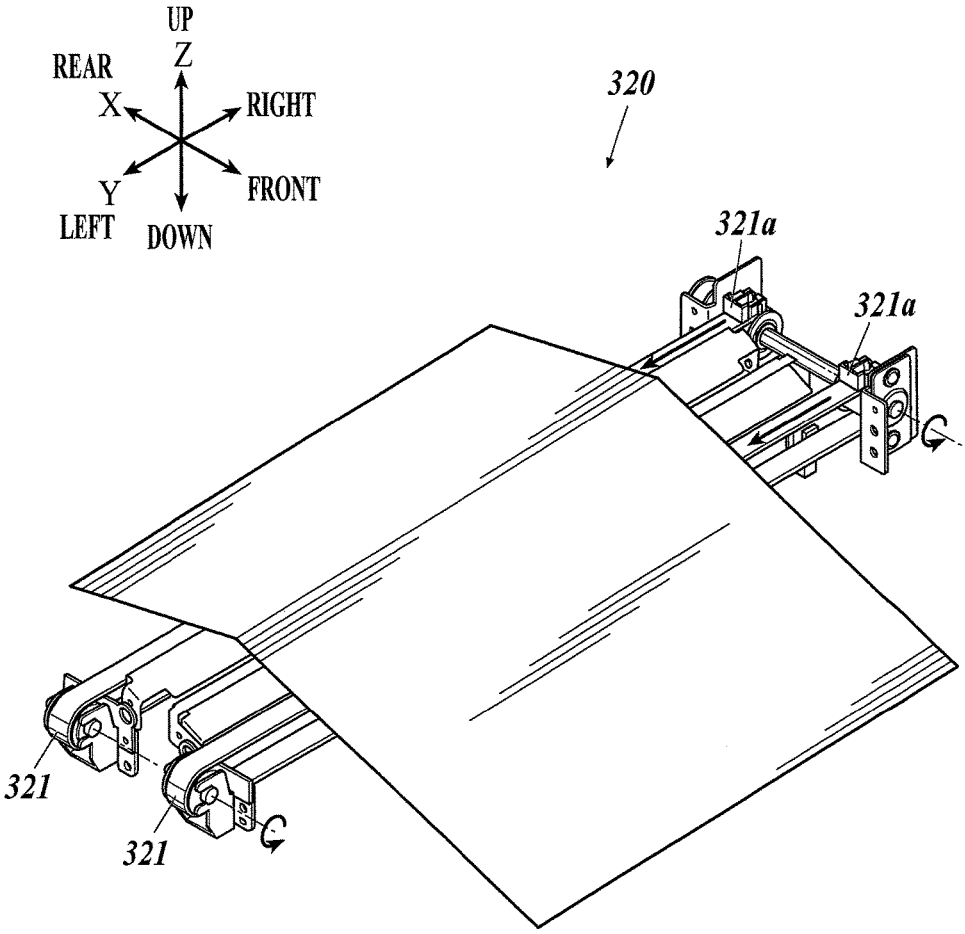
FIG. 3 is a schematic perspective view illustrating a configuration of a conveyance mechanism in the sheet processing apparatus as an example.

FIG. 3 is a perspective view illustrating the configuration of the conveyance mechanism 320 as an example.

The conveyance mechanism 320 includes two conveyance belts 321, 321, for example.

The two conveyance belts 321, 321 are disposed so as to extend in the Y direction sandwiching the folding knife therebetween as shown in FIGS. 2 and 3, and conveys the half-folded sheet in the direction (Y direction) along the folding line.

The two conveyance belts 321, 321 start rotating after the sheet is folded in two by the folding knife 313 moving up and down in the Z direction.

Abutting portions 321*a*, 321*a* are fixed on the respective conveyance belts 321, 321 so as to protrude from their surfaces. The abutting portions 321*a*, 321*a* on the conveyance belts 321, 321 move according to the rotation of the conveyance belts 321, 321 to abut with the back end in conveyance direction (right end) of the half-folded sheet, push the abutting sheet to the accumulating section 340 and thereafter return to the initial position not abutting the back end in conveyance direction of the sheet.

The half-folded sheet is conveyed to the after-mentioned accumulating section 340 in the saddle stitching section 330 by such conveyance mechanism 320.

Figure 4:
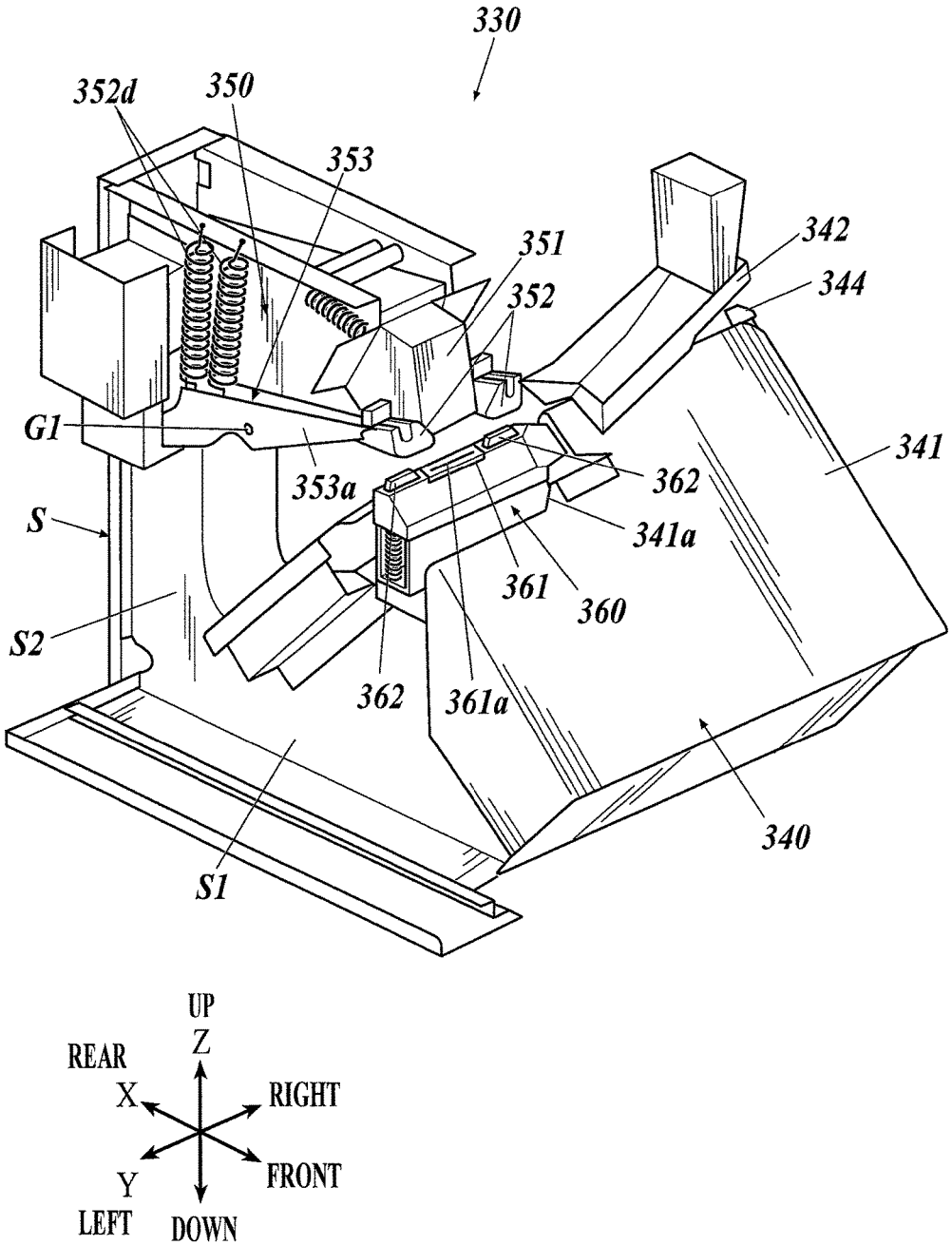
FIG. 4 is a schematic perspective view illustrating a configuration of a saddle stitching section in the sheet processing apparatus as an example.
Figure 5:
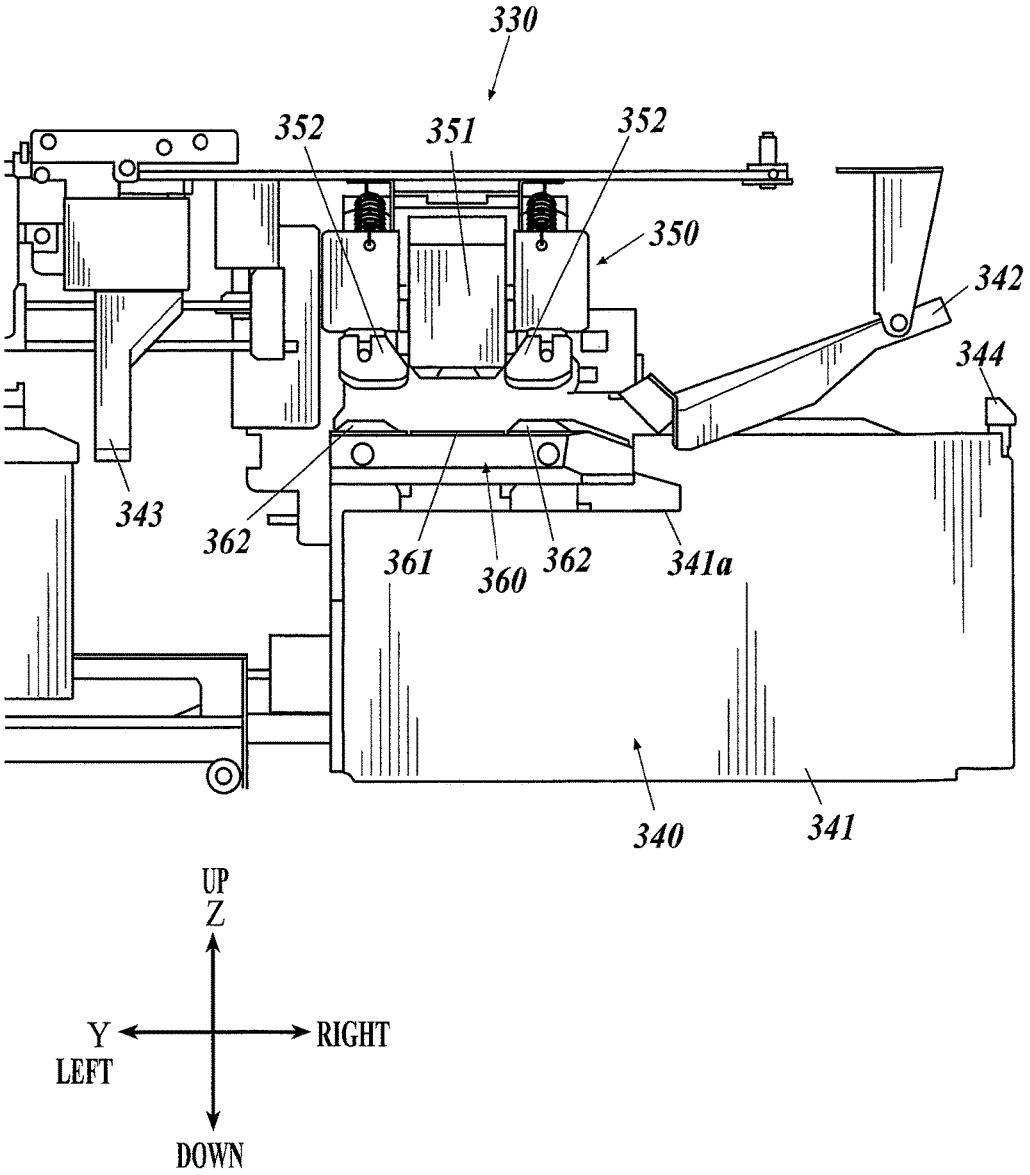
FIG. 5 is a front view of the saddle stitching section in FIG. 4.
Figure 6:
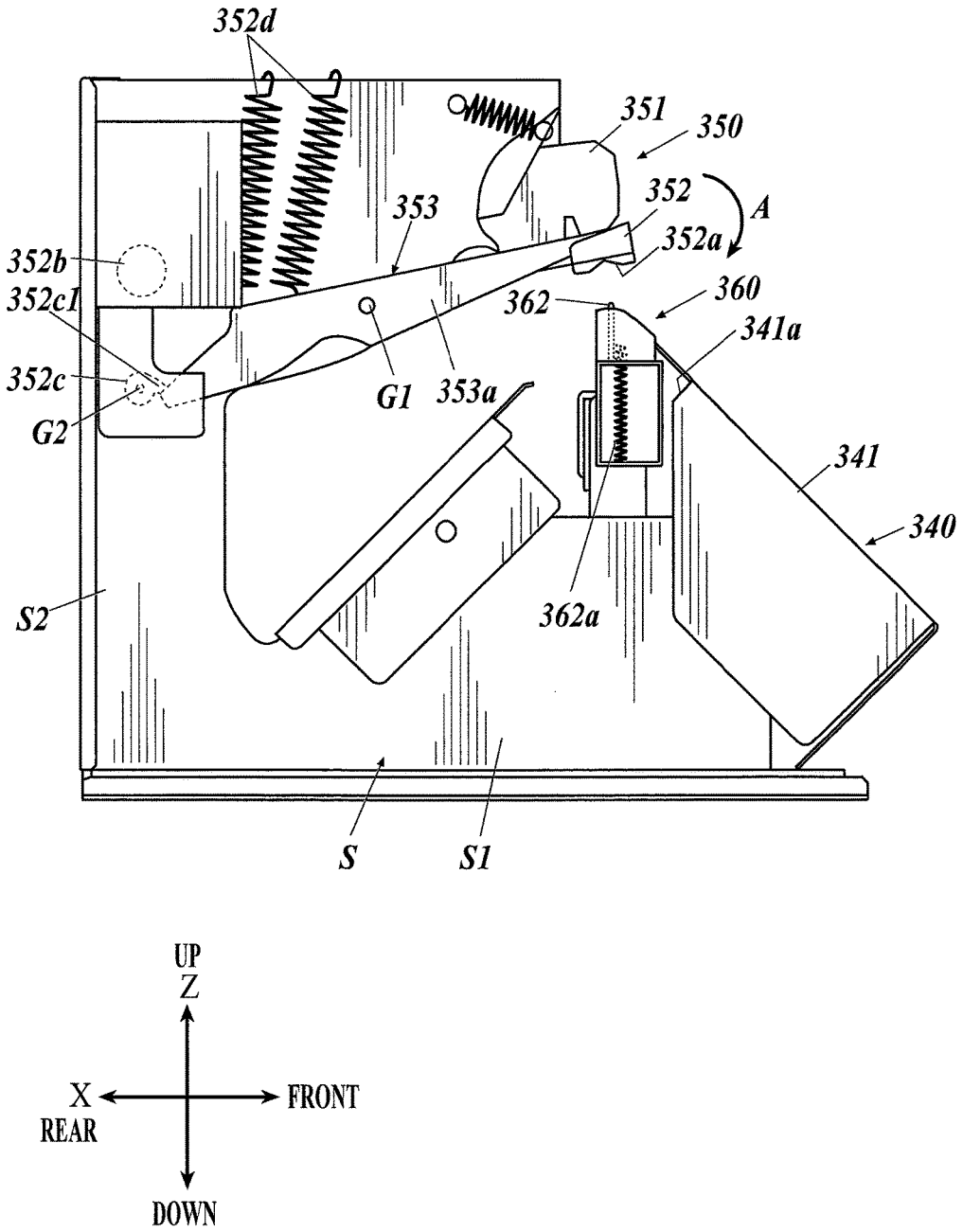
FIG. 6 is a left side view of the saddle stitching section in FIG. 4.

FIG. 4 is a perspective view illustrating the configuration of the saddle stitching section 330 as an example. FIG. 5 is a front view of the saddle stitching section 330 in FIG. 4. FIG. 6 is a left side view of the saddle stitching section in FIG. 4. In FIG. 4, the illustration of a front-end aligner 343 is omitted. In FIG. 6, the illustration of a guide member 342 is omitted.

The saddle stitching section 330 includes an accumulating section 340 to overlie and accumulate sheets conveyed by the conveyance mechanism 320, a staple inserting section 350 provided above the accumulating section 340, a staple receiving section 360 provided inside the accumulating section 340 and a supporting section S to support the sections.

The supporting section S includes a base portion S1 extending in the X direction and a standing portion S2 provided to be vertical from a base end of the base portion S1. The accumulating section 340 and the staple receiving section 360 are provided at the front end of the base portion S1 and the staple inserting section 350 is provided at the upper end of the standing portion S2.

The accumulating section 340 is provided next to the left end of the conveyance mechanism 320.

The accumulating section 340 includes, for example, a saddle unit 341 to place the sheets conveyed by the conveyance mechanism 320, a guide member 342 disposed above the right end of the saddle unit 341, a front-end aligner 343 to receive the front ends in the moving direction of the sheets, and a rear-end aligner 344 to tap the rear ends in the moving direction of the sheets for alignment of the sheets in the moving direction.

The saddle unit 341 is in a convex shape with the top part at an angle of nearly 90 degrees, and mountain-folded sheets which have been conveyed by the conveyance mechanism 320 are placed on the top part of the saddle unit 341 so as to straddle the saddle unit 341.

When each of the sheets to form a booklet is half-folded, the sheet is ejected and sequentially placed on the saddle unit 341 so that the sheet which is innermost of the booklet to be formed is located lowest.

A cut-out portion 341*a* to expose the top part of the staple receiving section 360 fixed inside the saddle unit 341 is formed at the left end of the top part of the saddle unit 341.

The guide member 342 serves to guide the sheet conveyed with the conveyance mechanism 320 onto the saddle unit 341.

The guide member 342 is a plate extending in the Y direction above the right end of the saddle unit 341. The guide member 342 is inclined toward the saddle unit 341 from upstream to downstream of the moving direction of the sheet.

The sheet conveyed with the conveyance mechanism 320 is pushed toward a clearance between the saddle unit 341 and the guide member 342, and is guided by the guide member 342 to move from the right to the left on the saddle unit 341.

With reference to FIG. 5, the front-end aligner 343 is disposed downstream of the saddle unit 341 in the moving direction of the sheet. The front-end aligner 343 receives the front end in the moving direction of the sheet which moves from the right to the left on the saddle unit 341 to stop the sheet. This configuration can arrange the half folded sheet at a predetermined position on the top ridge line of the saddle unit 341.

The position in the Y direction of the front-end aligner 343 is appropriately determined depending on the size of sheets to be accumulated on the saddle unit 341, and/or the position to receive a staple in the sheets.

The rear-end aligner 344 is disposed on the upper right end of the saddle unit 341, in a slidable manner in the Y direction along the top ridge line of the saddle unit 341. After the stacking of sheets on the saddle unit 341, the rear-end aligner 344 reciprocates in the Y direction along the top ridge line of the saddle unit 341, to tap the rear ends in the moving direction of the sheets for alignment of the sheets in the moving direction.

The staple inserting section 350 includes, for example, an inserting unit 351 which inserts a staple into the sheets accumulated on the saddle unit 341, two holding members 352, 352 disposed on both sides of the inserting unit 351 in the Y direction, and drive units 353 which drive the two holding members 352, 352 in the vertical direction (see FIG. 6).

The inserting unit 351 can be driven by a motor (not shown) to move along the arrow A in FIG. 6.

The inserting unit 351 accommodates staples thereinside. After coming into contact with the accumulated sheets, the inserting unit 351 inserts a staple through a staple outlet (not shown) provided at the lower end of the inserting unit 351.

The inserting unit 351 descends after a descending movement of the two holding members 352, 352, and inserts a staple into the sheets along the top ridge line (folding line).

The two holding members 352, 352 are disposed on both sides of the inserting unit 351 in the Y direction. The lower surfaces of the holding members 352, 352 are each provided with an inverted V-shaped guide groove 352*a* extending in the direction (Y direction) parallel to the folding lines of the sheets.

After the stacking of a predetermined number of sheets constituting a single booklet on the saddle unit 341, the holding members 352 descend in response to a swing of the arms 353*a* (described below) along the arrow A in FIG. 6, the arms 353*a* being driven by the drive units 353. The guide grooves 352*a* of the holding members 352 come into close contact with the top of the sheets. These guide grooves 352*a* facilitate holding of the sheets.

The drive units 353, which correspond to the respective holding members 352, 352, are disposed on the right and left sides of the inserting unit 351.

The drive units 353 each include the arm 353*a*, a drive motor 352*b*, a cam member 352*c*, and biasing members 352*d*.

With reference to FIG. 6, the arm 353*a* includes the holding member 352 at the tip and can swing around a shaft G1.

The drive motor 352*b* is a pulse motor, such as a stepping motor, for example. The drive motor 352*b* stepwisely rotates the rotor forward by a predetermined angle under the control of a saddle stitching control section 505. This configuration applies a rotary driving force to a driving-force transmitter (not shown), so that the driving-force transmitter rotates a shaft G2 of the cam member 352*c*.

The cam member 352*c* rotates forward in conjunction with the rotation of the shaft G2, to swing the arm 353*a* around the shaft G1.

In specific, the cam member 352*c* has a protrusion 352*c*1 protruding outward from a part of the outer periphery of the cam member 352*c*. When the cam member 352*c* rotates forward, the protrusion 352*c*1 comes into contact with the base end of the arm 353*a* to push the base end of the arm 353*a* downward. This operation raises the tip of the arm 353*a* to cause the holding member 352 to release the sheets.

When the cam member 352*c* further rotates forward, the protrusion 352*c*1 separates from the base end of the arm 353*a*, so that the base end of the arm 353*a* is raised by the biasing force of the biasing members 352*d*. This operation lowers the tip of the arm 353*a* to cause the holding member 352 to hold the sheets.

In the description of the present embodiment, the exemplary cam member 352*c* rotates in only one direction (forward). Alternatively, the cam member 352*c* may rotate both forward and rearward.

In this modification, when the cam member 352*c* rotates forward, the protrusion 352*c*1 comes into contact with the base end of the arm 353*a* to push the base end of the arm 353*a* downward. This operation causes the cam member 352*c* to rotate rearward so that the protrusion 352*c*1 separates from the base end of the arm 353*a* to allow the base end of the arm 353*a* to ascend.

The biasing members 352*d*, being extension coil springs, for example, each have an upper end connected to the upper sidewall provided on the right or left side of the inserting unit 351, and a lower end connected to the base end of the arm 353*a*. These biasing members 352*d* bias the base end of the arm 353*a* upward.

Although the example configuration in FIGS. 4 and 6 includes two biasing members 352*d* for each arm 353*a*, any other number of biasing members 352*d* may be provided as long as sufficient biasing force is applied to the base end of the arm 353*a*.

When the cam member 352*c* rotates rearward, the protrusion 352*c*1 separates from the base end of the arm 353*a*, so that the base end of the arm 353*a* is raised by the biasing force of the biasing members 352*d* while the tip of the arm 353*a* descends.

The staple receiving section 360 includes a staple receiving unit 361 accommodated in the saddle unit 341, and two supporting members 362, 362 disposed on both sides of the staple receiving unit 361 in the Y direction.

The staple receiving unit 361 is fixed in the saddle unit 341 such that the top of the staple receiving unit 361 is exposed through the cut-out portion 341*a* of the saddle unit 341. The upper surface of the staple receiving unit 361 is provided with a concavity 361*a* for receiving to bend the tips of a staple inserted by the inserting unit 351. In other words, the tips of the staple, which is inserted by the inserting unit 351 into the sheets, penetrate the sheets, and hit against and are bent by the concavity 361*a*.

The supporting members 362, 362 are disposed on both sides of the staple receiving unit 361 in the Y direction. The supporting members 362, 362 are disposed at positions opposite to the holding members 352, 352 of the staple inserting section 350, such that the supporting members 362, 362 are prominent from the upper surface of the staple receiving unit 361 and are downwardly retractable in response to the pressing force from above.

In specific, each supporting member 362 is supported by a spring member (biasing member) 362*a*, which applies biasing force to urge the supporting member 362 upward. When each holding member 352 descends, the supporting member 362 retracts downward in response to the pressing force of the holding member 352.

The supporting member 362 may be any member having a width in the X direction (direction orthogonal to the longitudinal direction of the guide groove), the width being narrower than the width of the guide groove 352*a* in the X direction. In the embodiment, the supporting member 362 is a plate-like member disposed along the Y-Z plane. The plate-like member should preferably have a sharp tip edge to fit the inverted V-shaped guide groove 352*a*.

The trimming section 370 trims the end surfaces of the booklet which has been saddle-stitched as described above. That is, the trimming section 370 performs trimming to align the end surfaces since the end surfaces of such saddle-stitched booklet are not aligned depending on the number of sheets forming the booklet.

The ejecting section 380 ejects the booklet having the end surfaces trimmed by the trimming section 370.

Returning to FIG. 1, the side stitching apparatus 400 performs side stitching to a plurality of sheets.

Specifically, the side stitching apparatus 400 includes, for example, a stapling section to staple a plurality of sheets received from the saddle stitching apparatus 300, a page end trimming section to trim a part of end portions of the plurality of stapled sheets so as to align the end portions which are parallel to the spine, and an ejecting section to eject the sheets which have been processed by the connected apparatuses.

The side stitching apparatus 400 can eject the sheets received from the saddle stitching apparatus 300 without performing a part or all of the various processes by the side stitching apparatus 400.

Next, the operation control of the image forming system 1 will be described.

Figure 7:
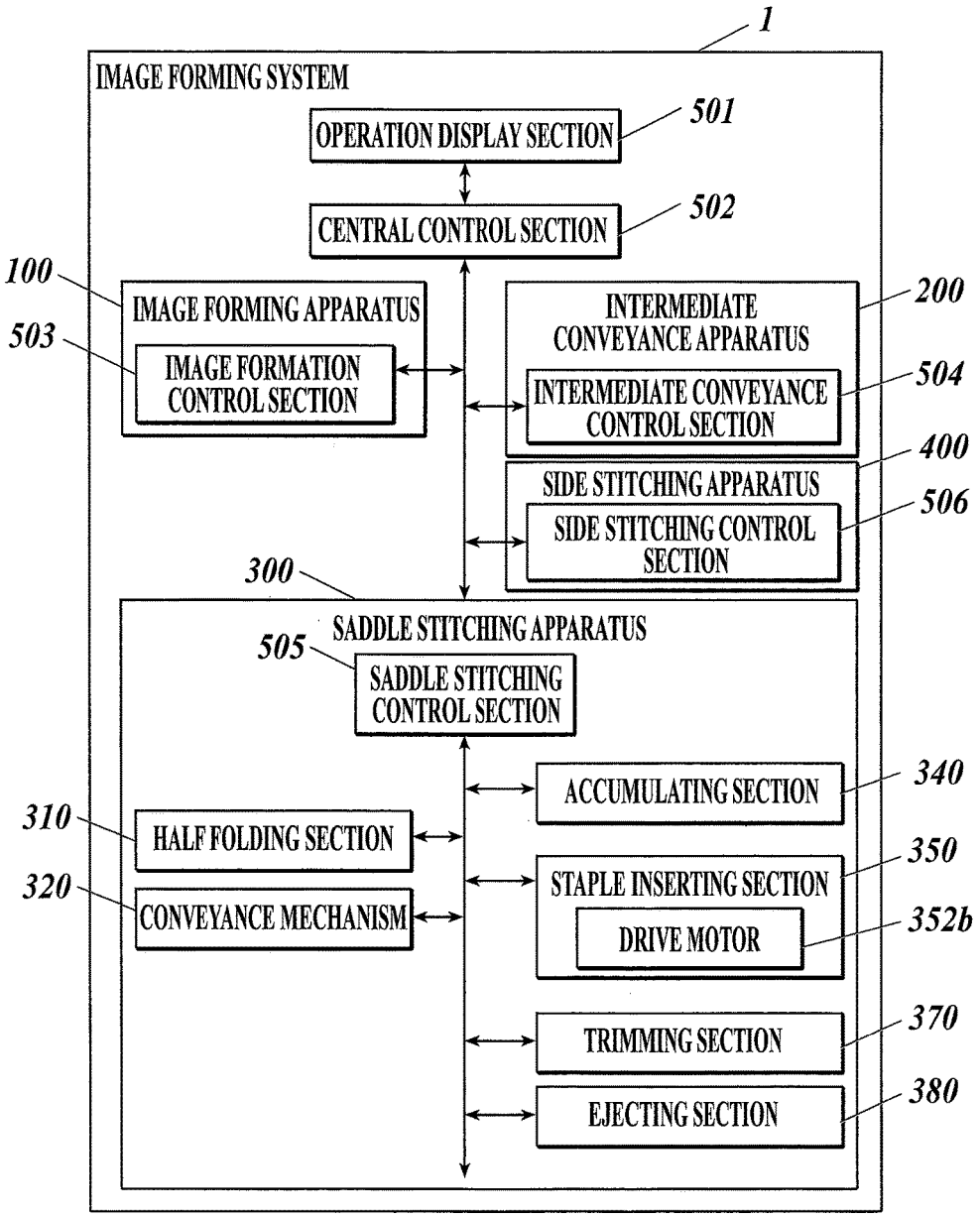
FIG. 7 is a block diagram showing a main configuration according to the operation control of the image forming system.

FIG. 7 is a block diagram showing the main configuration according to the operation control in the image forming system 1.

The image forming system 1 includes an operation display section 501 which receives input operation from a user according to the operation of the image forming system 1 and performs display according to the operation of the image forming system 1, a central control section 502 which controls operations of the entire image forming system 1, an image formation control section 503 which controls operations of the image forming apparatus 100, an intermediate conveyance control section 504 which controls operations of the intermediate conveyance apparatus 200, a saddle stitching control section (control section, staple inserting unit) 505 which controls operations of the saddle stitching apparatus 300 and a side stitching control section 506 which controls operations of the side stitching apparatus 400.

The operation display section 501 includes, for example, a touch panel type operation display unit or switches and keys for various types of input to send a signal according to the input from the user to the central control section 502.

Each of the central control section 502, the image formation control section 503, the intermediate conveyance control section 504, the saddle stitching control section 505, and the side stitching control section 506 includes a CPU (Central Processing Unit), a RAM (Random Access Memory), a ROM (Read Only Memory) and such like to read out a software program and various types of data according to processing and execute the processing.

In response to the input from the user via the operation display section 501, the central control section 502 sets various types of conditions according to the image forming system 1 such as sheet size and the number of colors to form images (for example, full-color, gray scale or monochrome), the number of sheets in a single booklet to be saddle-stitched, whether to trim the end portions which are margins, the width of the end portions to be trimmed and nip pressure in the half folding processing. Then, the central control section 502 outputs instructions to perform the processing according to the setting to the image formation control section 503, the intermediate conveyance control section 504, the saddle stitching control section 505 and the side stitching control section 506. The control sections control operations of the respective apparatuses to be controlled according to the instructions.

For example, the central control section 502 outputs an instruction for performing half folding and saddle stitching to the saddle stitching control section 505.

In response to this, the saddle stitching control section 505 controls the half folding section 310 to perform half folding and controls the saddle stitching section 330 to perform saddle stitching.

The saddle stitching is executed according to the setting condition set by the user operating the operation display section 501. The setting condition includes, for example, the number and position of staples to be put into the sheets along the folding line in addition to the type, basis weight and the number of sheets to be saddle stitched.

Operations of the holding members 352, 352 and the supporting members 362, 362 in the saddle stitching process will now be explained.

Figure 8A:
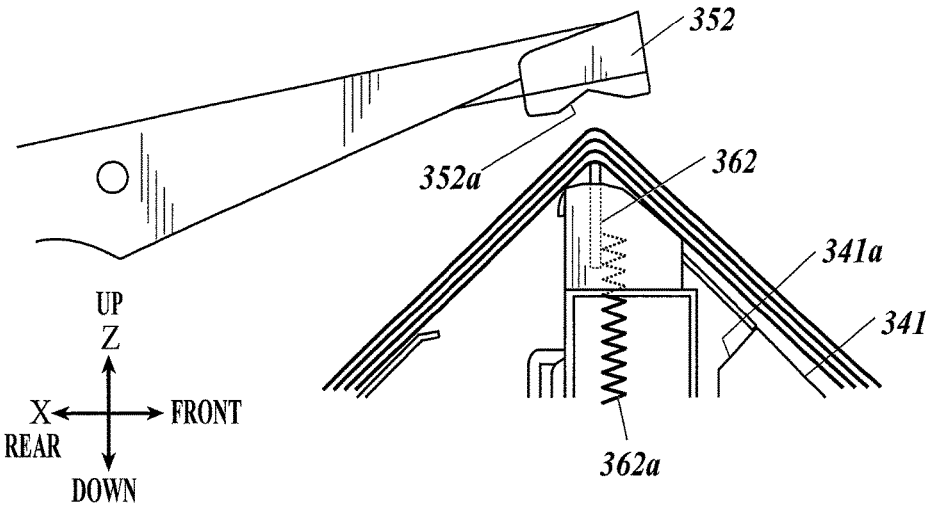
FIG. 8A is a view for explaining operations of holding members and supporting members.
Figure 8B:
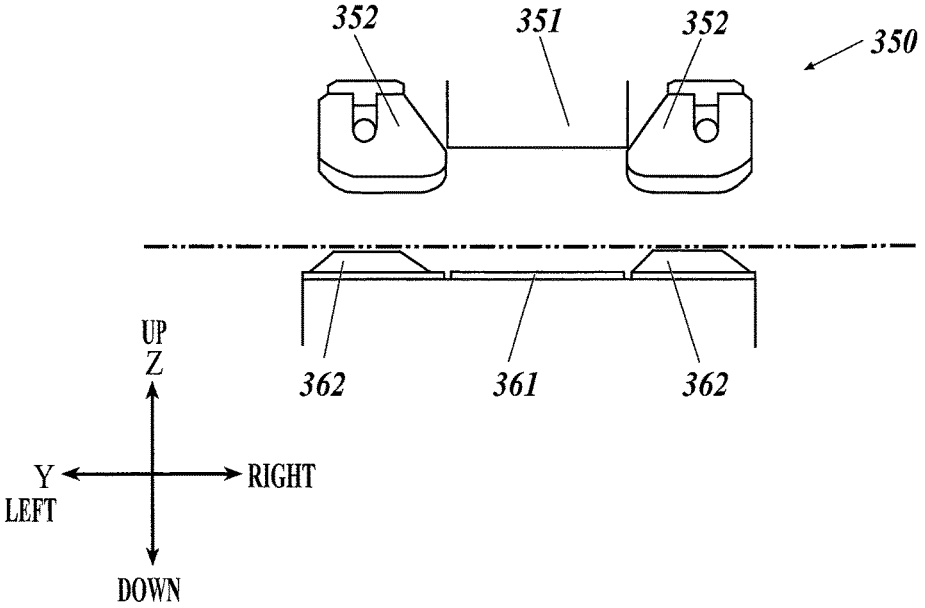
FIG. 8B is a view for explaining operations of holding members and supporting members.
Figure 9A:
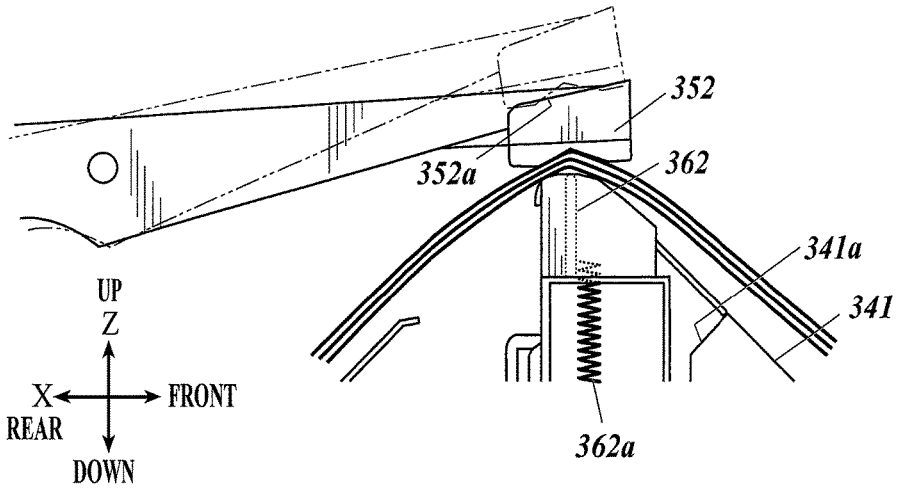
FIG. 9A is a view for explaining operations of holding members and supporting members.
Figure 9B:
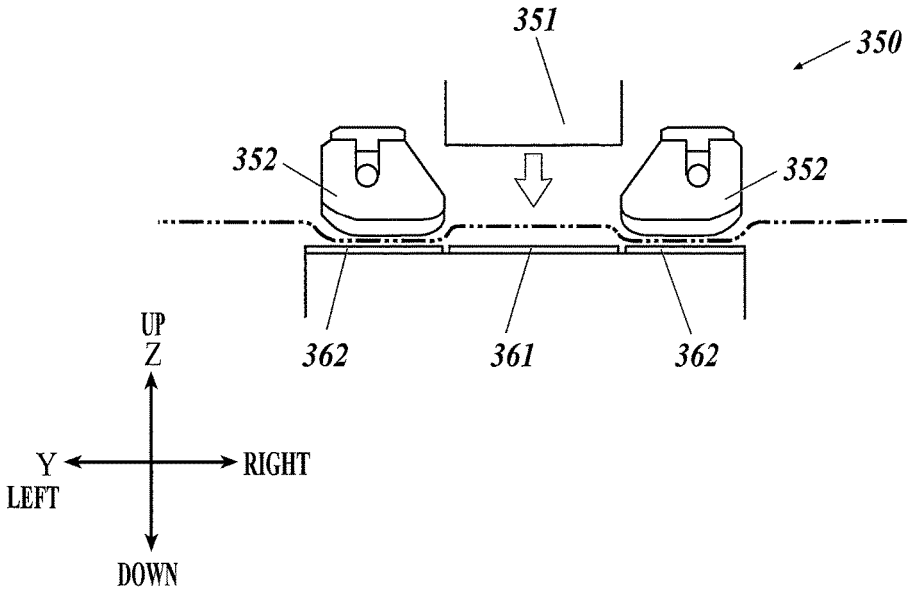
FIG. 9B is a view for explaining operations of holding members and supporting members.

FIGS. 8A and 8B each illustrate the holding members 352, 352 that are apart from the supporting members 362, 362, while FIGS. 9A and 9B each illustrate the holding members 352, 352 that are in contact with the supporting members 362, 362.

In FIGS. 8B and 9B, the uppermost sheet in the accumulated sheets is illustrated with a two-dot chain line.

At a timing when sheets are conveyed onto the saddle unit 341 of the accumulating section 340, the inserting unit 351 and the holding members 352, 352 are apart from the staple receiving unit 361 and the supporting members 362, 362, under the control of the saddle stitching control section 505 (see FIGS. 8A and 8B).

After accumulating of a predetermined number of sheets on the saddle unit 341 of the accumulating section 340, the saddle stitching control section 505 controls the drive motor 352*b* so that the arms 353*a* swing and the holding members 352, 352 descend.

This operation causes the holding members 352, 352 to press against the supporting members 362, 362 via the sheets.

In response to the pressing force of the holding members 352, 352 from above, the supporting members 362, 362 retract downward against the biasing force of the spring members 362*a* (see FIGS. 9A and 9B).

The sheets are held between the holding members 352, 352 and the supporting members 362, 362, such that the ridge of the sheets is flattened due to the retraction of the supporting members 362, 362. In specific, the top portions of the sheets defining an angle of approximately 90° are unfolded into an angle of approximately 140°.

The inserting unit 351 then descends to insert a staple into a predetermined position on the folding lines of the sheets, under the control of the saddle stitching control section 505.

As described above, the configuration according to the embodiment includes the holding members 352, 352 disposed on both sides of the inserting unit 351, and the supporting members 362, 362 disposed on both sides of the staple receiving unit 361 at positions opposite to the respective holding members 352, 352. When the inserting unit 351 inserts a staple into the folding lines of the sheets accumulated on the saddle unit 341, the saddle stitching control section 505 controls the drive units 353 so that the sheets are held between the holding members 352, 352 and the supporting members 362, 362.

The sheets are fixed with the holding members 352, 352 and the supporting members 362, 362 during the driving of a staple into the folding lines of the accumulated sheets. This configuration can insert a staple without misalignment of the stitch with the folding lines of the sheets. Thus the stitch is accurately aligned with the folding lines of the accumulated sheets.

According to the embodiment, the supporting members 362, 362 are prominent from the upper surface of the staple receiving unit 361, and the uppermost positions of the supporting members 362, 362 are lowered in response to the pressing force of the holding members 352, 352.

While the sheets are held between the holding members 352, 352 and the supporting members 362, 362, the ridge of the sheets to be stitched is flattened. This configuration has a reduced space between the lower surface of the sheets and the staple receiving unit 361, thereby preventing the tips of a staple from buckling.

The configuration, having the ridge of the sheets to be stitched in a flattened state, requires a shorter penetration length of a staple to staple the sheets than that in an unflattened state, so that a larger number of sheets can be stitched.

According to the embodiment, the supporting members 362, 362 are supported by the spring members 362*a*, which apply biasing force to urge the supporting members 362, 362 upward, and retract downward against the biasing force of the spring members 362*a* in response to the pressing force of the holding members 352, 352.

This configuration can readily lower the uppermost positions of the supporting members 362, 362 in response to the pressing force of the holding members 352, 352.

According to the embodiment, the lower surfaces of the holding members 352, 352 are each provided with the guide groove 352*a* extending in the direction parallel to the folding lines of the sheets, and the width of each of the supporting members 362, 362 in the direction orthogonal to the longitudinal direction of the guide groove 352*a* is narrower than the width of the guide groove 352*a*.

When the holding members 352, 352 come into contact with the sheets, the ridge of the sheets is guided along the guide grooves 352*a* while the lower surface of the sheets in the guide grooves 352*a* is supported by the supporting members 362, 362. This configuration can achieve alignment of the folding lines.

The staple inserting section 350 descends relative to the accumulating section 340 and the staple receiving section 360 in the above description of the embodiment. Alternatively, the accumulating section 340 and the staple receiving section 360 may ascend relative to the fixed staple inserting section 350.

The supporting members 362, 362 are supported by the spring members 362*a* and retract downward in response to the pressing force of the holding members 352, 352 in the above description of the embodiment. Alternatively, the supporting members 362, 362 may not be retractable provided that the ridge of the sheets is fixed during the stitching process.

For example, although the supporting members 362, 362 are prominent from the upper surface of the staple receiving unit 361 in the above description of the embodiment, the supporting members 362, 362 may be level with the upper surface of the staple receiving unit 361.

In the configuration including the retractable supporting members 362, 362, the supporting members 362, 362 are supported by the spring members 362*a* in the above description of the embodiment. Alternatively, the supporting members 362, 362 may be formed of elastic material, such as rubber or sponge, and may be supported by undeformable rod-like members instead of the spring members 362*a*, for example.

The two supporting members 362, 362 are disposed on both sides of the staple receiving unit 361 at a part (the left end) of the top of the saddle unit 341, as illustrated in the drawings such as FIG. 4, in the above description of the embodiment. Alternatively, the supporting members 362 may occupy the entire top of the saddle unit 341 other than the staple receiving unit 361.

The entire disclosure of Japanese Patent Application No. 2013-151734 filed on Jul. 22, 2013 including description, claims, drawings, and abstract are incorporated herein by reference in its entirety.

What is claimed is:

1. A sheet processing apparatus comprising:

a saddle unit on which a mountain-folded sheet folded along a folding line at a middle portion is accumulated so as to straddle the saddle unit;

a staple inserting section disposed above the saddle unit;

a staple receiving section accommodated in the saddle unit; and a control section which controls the staple inserting section, wherein the staple inserting section comprises:

an inserting unit which inserts a staple into the folding lines of sheets accumulated on the saddle unit;

holding members disposed on both sides of the inserting unit in a direction parallel to the folding lines of the sheets accumulated on the saddle unit; and a drive unit which drives the holding members in a vertical direction, wherein the staple receiving section comprises:

a staple receiving unit which receives and bends tips of the staple inserted by the inserting unit; and supporting members which are at least partly contained in containers disposed on both sides of the staple receiving unit at positions opposite to the holding members, respectively, top surfaces of the containers being adjacent to a top surface of the staple receiving unit, wherein the control section controls the drive unit so that the sheets are held between the holding members and the supporting members during driving of the staple into the folding lines of the sheets accumulated on the saddle unit by the inserting unit, wherein the supporting members are in a first position in which the supporting members are prominent from the top surfaces of the containers while the holding members are separated from the supporting members, and wherein the supporting members retract downward in response to a pressing force of the holding members to be in a second position in which a distance between top ends of the supporting members and the top surfaces of the containers is smaller than that in the first position, wherein the second position is a position such that the sheets are held between the holding members and the supporting members in the second position in a state that both sides of the folding line of one of the sheets contact the top surfaces of the containers and such that a ridge of the sheets is flattened and the sheets spread in a direction perpendicular to the ridge.

2. The sheet processing apparatus according to claim 1, wherein the supporting members are provided separately from the saddle unit.

3. The sheet processing apparatus according to claim 1, wherein the supporting members are supported by biasing members which apply a biasing force to urge the supporting members upward, and wherein the supporting members retract downward against the biasing force of the biasing members, in response to the pressing force of the holding members.

4. The sheet processing apparatus according to claim 1, wherein the holding members have lower surfaces each including a guide groove extending in the direction parallel to the folding lines of the sheets, and wherein a width of each of the supporting members is narrower than a width of its respective guide groove in a direction orthogonal to a longitudinal direction of its respective guide groove.

5. The sheet processing apparatus according to claim 1, wherein, when the supporting members retract downward in response to the pressing force of the holding members, top portions of the sheets are unfolded into an angle larger than 90°.

6. The sheet processing apparatus according to claim 1, wherein, when the supporting members retract downward in response to the pressing force of the holding members, top portions of the sheets are unfolded into an angle of approximately 140°.

7. An image forming system comprising:

an image forming apparatus to form images on sheets; and the sheet processing apparatus according to claim 1, the sheet processing apparatus being connected to the image forming apparatus to execute a saddle stitching process on the sheets having the images formed thereon by the image forming apparatus.

* * * * *